US011239609B2

(12) United States Patent
Tang et al.

(10) Patent No.: US 11,239,609 B2
(45) Date of Patent: Feb. 1, 2022

(54) CARD EDGE CONNECTOR WITH COVERING BLOCK OCCUPYING CONTACT PASSAGEWAYS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Wen-Jun Tang, Kunshan (CN); Teng Qin, Kunshan (CN); Xiao-Qin Zheng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/983,777

(22) Filed: Aug. 3, 2020

(65) Prior Publication Data

US 2021/0036465 A1 Feb. 4, 2021

(30) Foreign Application Priority Data

Aug. 1, 2019 (CN) ..... 201910706330.5

(51) Int. Cl.
*H01R 13/64* (2006.01)
*H01R 13/6471* (2011.01)
(Continued)

(52) U.S. Cl.
CPC ..... *H01R 13/6471* (2013.01); *H01R 12/721* (2013.01); *H01R 12/737* (2013.01); *H01R 13/50* (2013.01); *H01R 13/6597* (2013.01)

(58) Field of Classification Search
CPC ..... H01R 13/6461; H01R 13/6597; H01R 13/50; H01R 13/6471; H01R 13/6599;
(Continued)

(56) References Cited

U.S. PATENT DOCUMENTS 6,954,363 B2 * 10/2005 Fan ..... H01R 13/631 361/816
8,585,440 B2 * 11/2013 Jiang ..... H01R 13/6477 439/626

(Continued)

*Primary Examiner* — Marcus E Harcum
(74) *Attorney, Agent, or Firm* — Ming Chieh Chang; Wei Te Chung

(57) ABSTRACT

A card edge connector includes an insulative housing extending along a lengthwise direction, two rows of (contact) passageways formed in two opposite side walls with a central slot therebetween. Two rows of contacts are disposed within the corresponding passageways, respectively. The contacts include signal contacts and grounding contacts. Each side wall further forms an elongated channel by two sides of central wall under the central slot. A covering block is upwardly assembled into the corresponding channel after the corresponding contacts have been assembled into the corresponding passageways. Each block includes a deflectable latch engaged with the central wall. The covering block occupies at least one half of each passageway in the transverse direction perpendicular to the lengthwise direction. The covering block is optimally made of conductive plastic and forms a plurality of abutment ribs to respectively abut against the corresponding grounding contacts, respectively.

19 Claims, 8 Drawing Sheets

(51) Int. Cl.
*H01R 12/72* (2011.01)
*H01R 12/73* (2011.01)
*H01R 13/50* (2006.01)
*H01R 13/6597* (2011.01)

(58) Field of Classification Search
CPC .. H01R 12/721; H01R 12/712; H01R 12/716; H01R 12/725; H01R 12/727; H01R 12/737
USPC ..... 439/108, 86, 636, 637, 931
See application file for complete search history.

(56) References Cited

U.S. PATENT DOCUMENTS 9,281,589 B2 * 3/2016 Hsiao ..... H01R 4/04
9,490,585 B2 * 11/2016 Yang ..... H01R 13/6585
9,882,298 B2 1/2018 Zeng
9,941,641 B1 * 4/2018 Jiang ..... H01R 13/6585
10,243,304 B2 * 3/2019 Kirk ..... H01R 13/6473
10,283,910 B1 * 5/2019 Chen ..... H01R 4/04
10,381,767 B1 8/2019 Milbrand, Jr. et al.
10,411,411 B2 * 9/2019 Tang ..... H01R 13/6587
10,581,206 B2 3/2020 Fang et al.
10,777,921 B2 * 9/2020 Lu ..... H01R 12/82
10,847,936 B2 * 11/2020 Tang ..... H01R 13/405
11,056,834 B2 * 7/2021 Casher ..... H01R 13/2442
2010/0255725 A1 * 10/2010 Shih ..... A61P 31/14 439/607.01
2012/0156912 A1 * 6/2012 Shen ..... H01R 13/6275 439/327
2012/0184145 A1 * 7/2012 Zeng ..... H01R 13/6471 439/626
2014/0127946 A1 * 5/2014 Ito ..... H01R 13/6599 439/629
2014/0364000 A1 * 12/2014 Tang ..... H01R 12/7005 439/345
2014/0377972 A1 * 12/2014 Tang ..... H01R 12/721 439/157
2015/0188250 A1 * 7/2015 Liu ..... B29C 45/1671 439/86
2017/0018880 A1 * 1/2017 Phillips ..... H01R 12/727
2017/0170606 A1 * 6/2017 Phillips ..... H01R 12/7005
2017/0187157 A1 * 6/2017 Hsu ..... H01R 12/7005
2018/0198220 A1 7/2018 Sasame et al.
2019/0173209 A1 6/2019 Lu et al.
2019/0214753 A1 * 7/2019 Jiang ..... H01R 12/721
2019/0214755 A1 * 7/2019 Manickam ..... H01R 12/721
2020/0212632 A1 * 7/2020 Liong ..... H01R 12/716
2020/0266584 A1 * 8/2020 Lu ..... H01R 12/79
2020/0350717 A1 * 11/2020 Dong ..... H01R 13/112
2020/0381868 A1 * 12/2020 Lin ..... H01R 13/6471
2020/0412060 A1 * 12/2020 Hsieh ..... H01R 12/73

* cited by examiner

CARD EDGE CONNECTOR WITH COVERING BLOCK OCCUPYING CONTACT PASSAGEWAYS

BACKGROUND OF THE INVENTION

1. Field of the Invention

The present invention relates generally to an electrical connector, and particularly to the card edge connector with covering blocks occupying the contact passageways after the contacts have been assembled within the corresponding contact passageways.

2. Description of Related Arts

China Patent No. CN207572652U discloses a card edge connector equipped with a grounding bar selectively connecting the corresponding grounding contacts for meeting high frequency transmission. Anyhow, on one hand because most of the lower portions of the housing are removed to receive such a grounding bar, the whole housing of the connector is not relatively rigid, thus tending to be broken compared with the traditional card edge connector. On the other hand, the grounding/shielding effect may not satisfy the severe situation.

Hence, an electrical contact with improved structure to meet both the mechanical performance and the electrical performance is desired.

SUMMARY OF THE INVENTION

To achieve the above object, a card edge connector includes an insulative housing extending along a lengthwise direction, two rows of (contact) passageways formed in two opposite side walls with a central slot therebetween. Two rows of contacts are disposed within the corresponding passageways, respectively. The contacts include signal contacts and grounding contacts. Each side wall further forms an elongated channel by two sides of central wall under the central slot. A covering block is upwardly assembled into the corresponding channel after the corresponding contacts have been assembled into the corresponding passageways. Each block includes a deflectable latch engaged with the central wall. The covering block occupies at least one half of each passageway in the transverse direction perpendicular to the lengthwise direction. The covering block is optimally made of conductive plastic and forms a plurality of abutment ribs to respectively abut against the corresponding grounding contacts, respectively.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
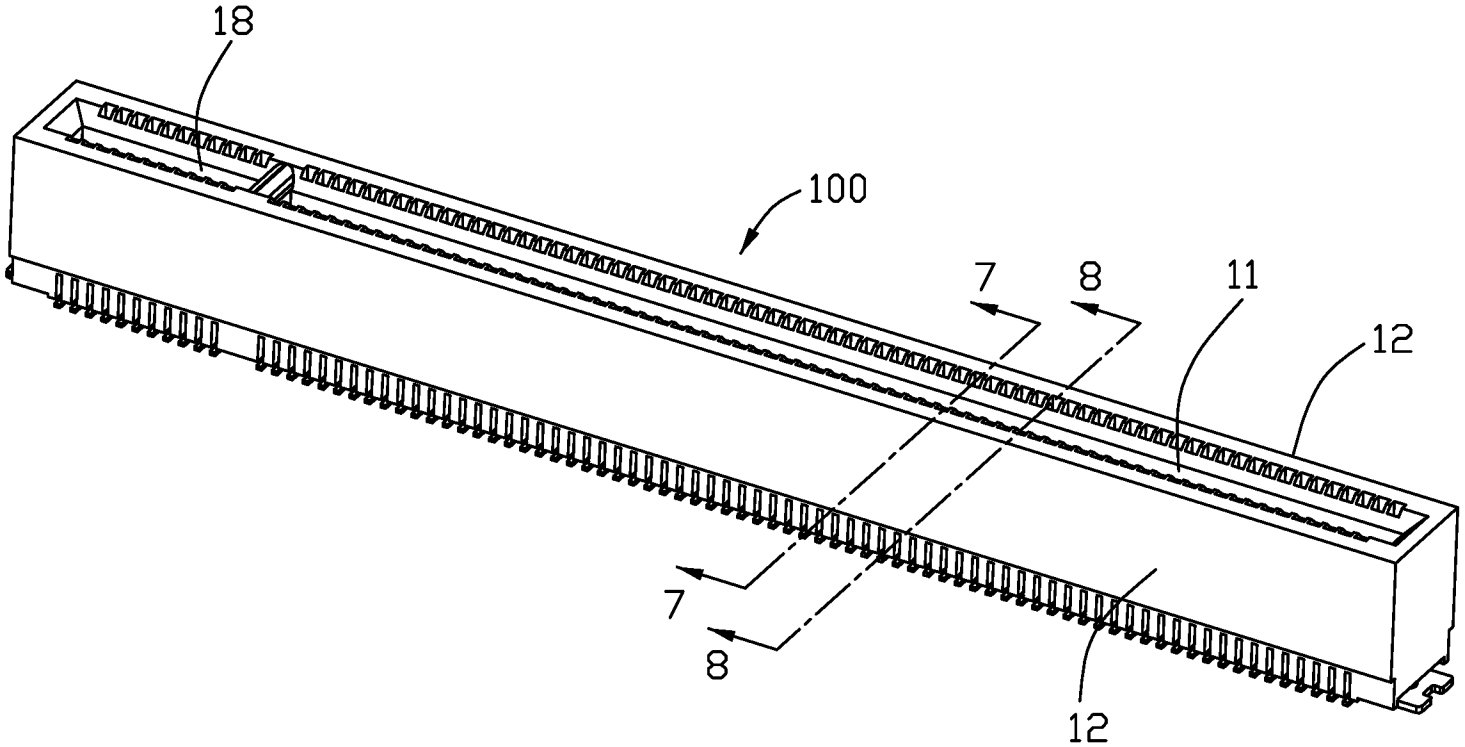
FIG. 1 is a perspective view of the electrical connector of the present invention.
Figure 2:
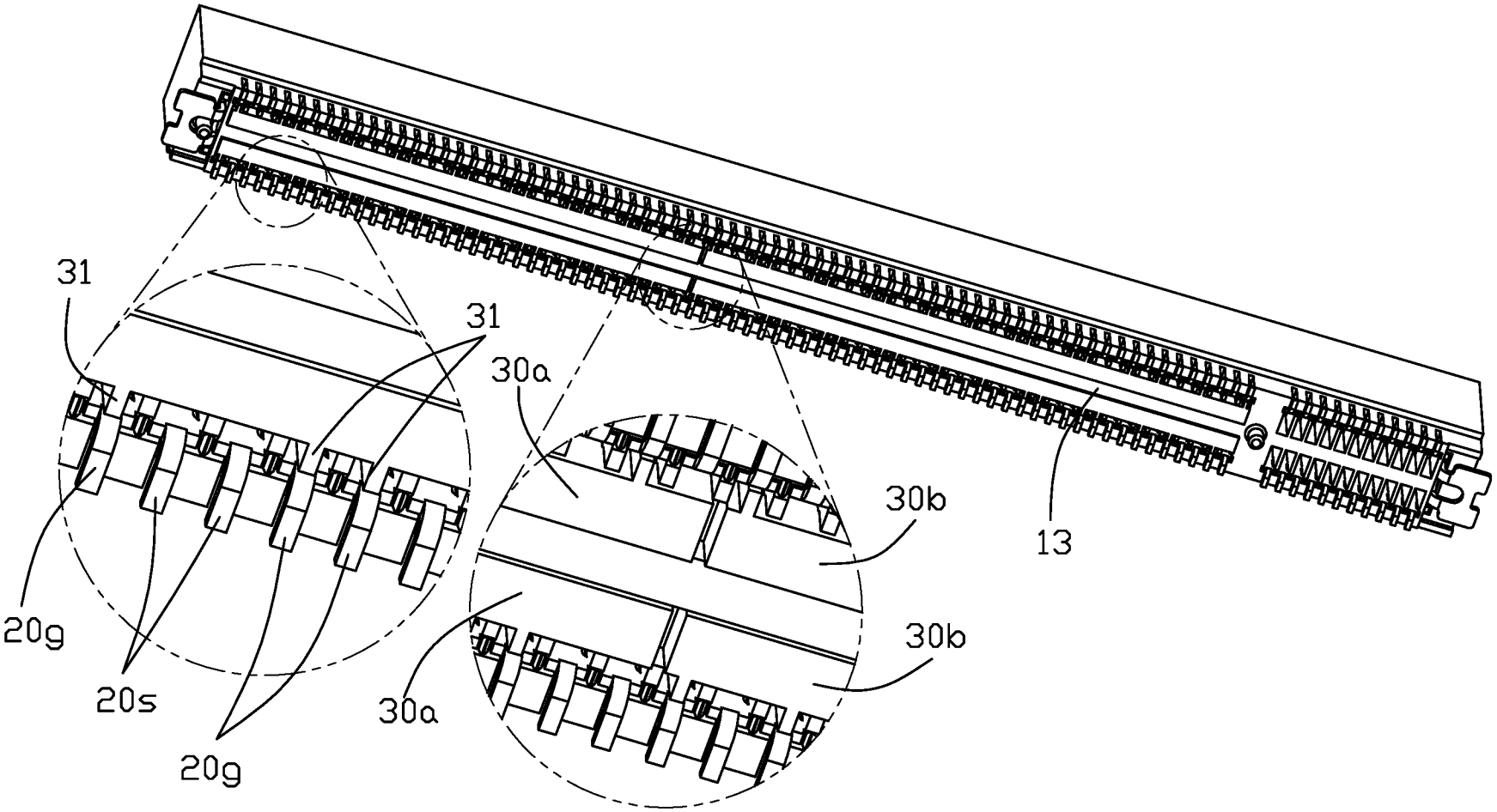
FIG. 2 is another perspective view of the electrical connector of FIG. 1.
Figure 3:
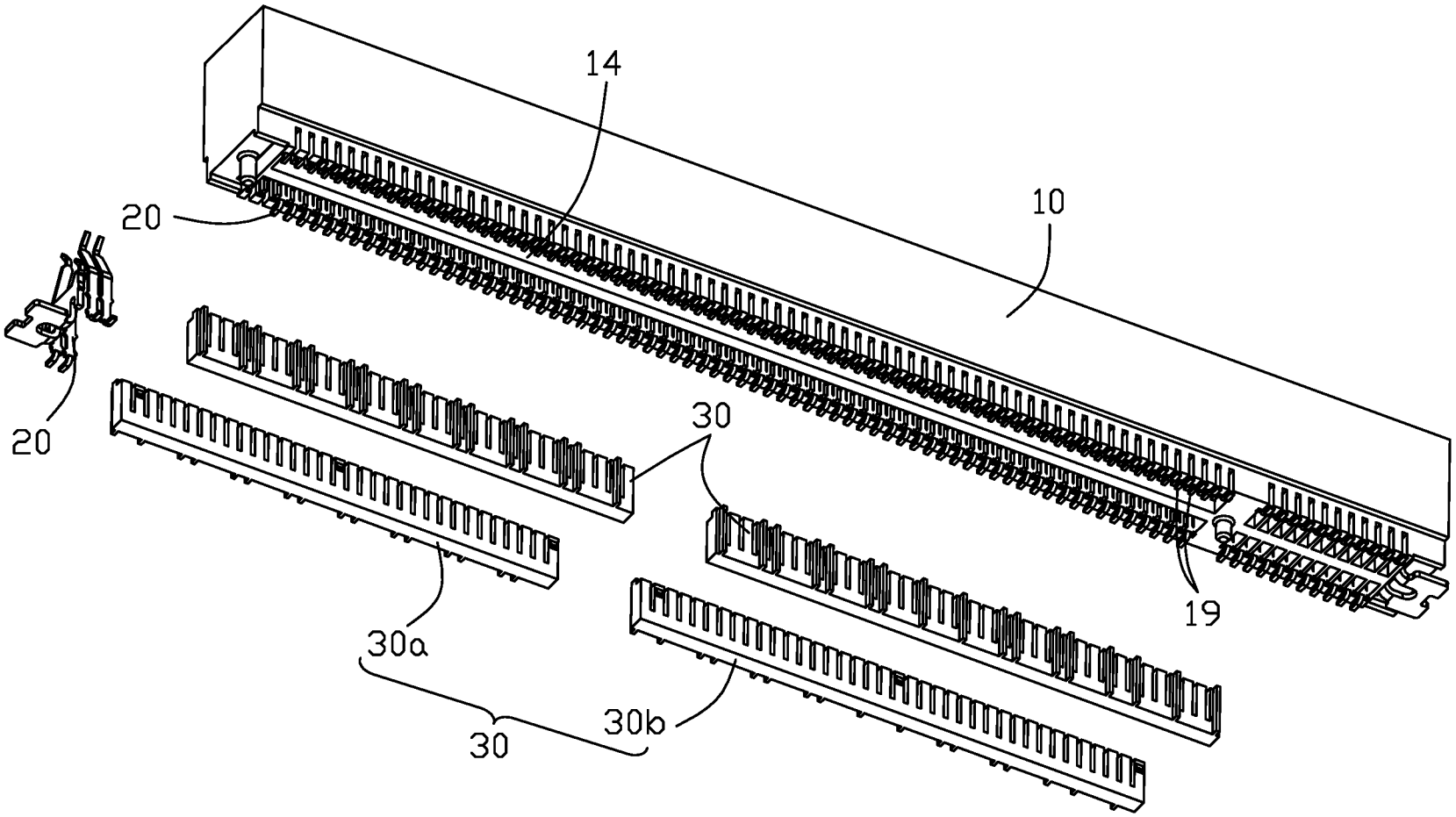
FIG. 3 is an exploded perspective view of the electrical connector of FIG. 2.
Figure 4:
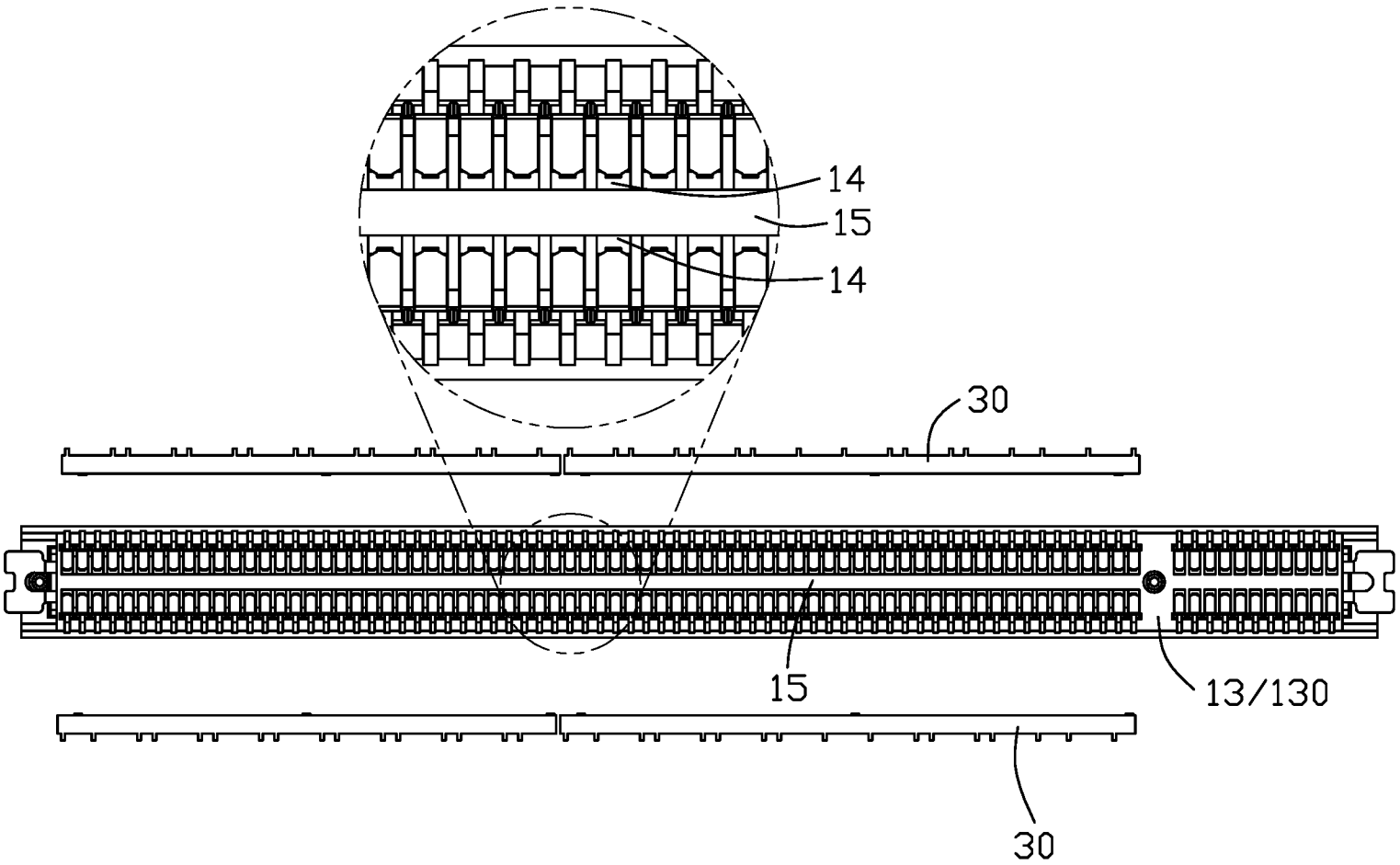
FIG. 4 is a bottom view of the electrical connector of FIG. 3.
Figure 5:
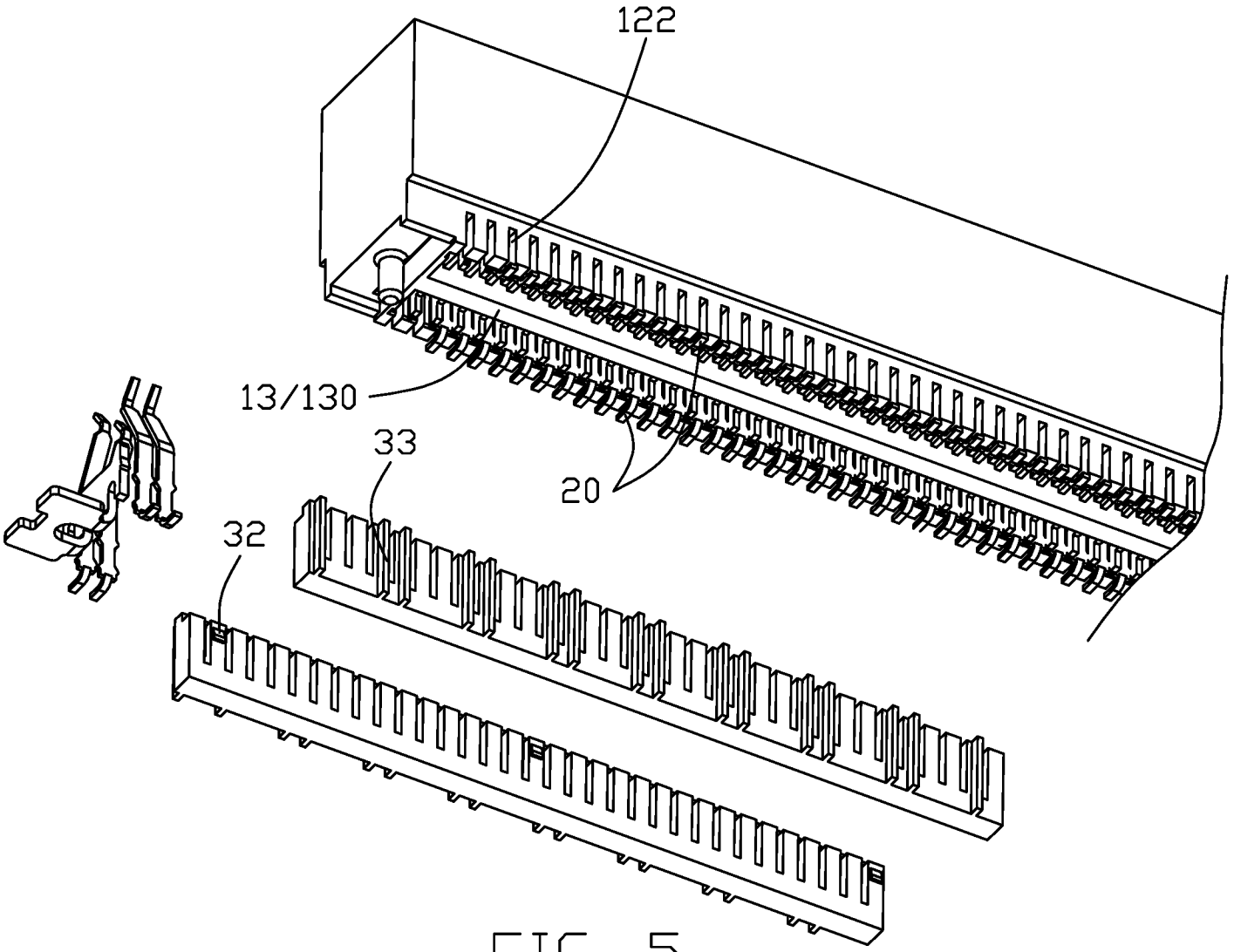
FIG. 5 is an exploded perspective view of a portion of the electrical connector of FIG. 3.
Figure 6:
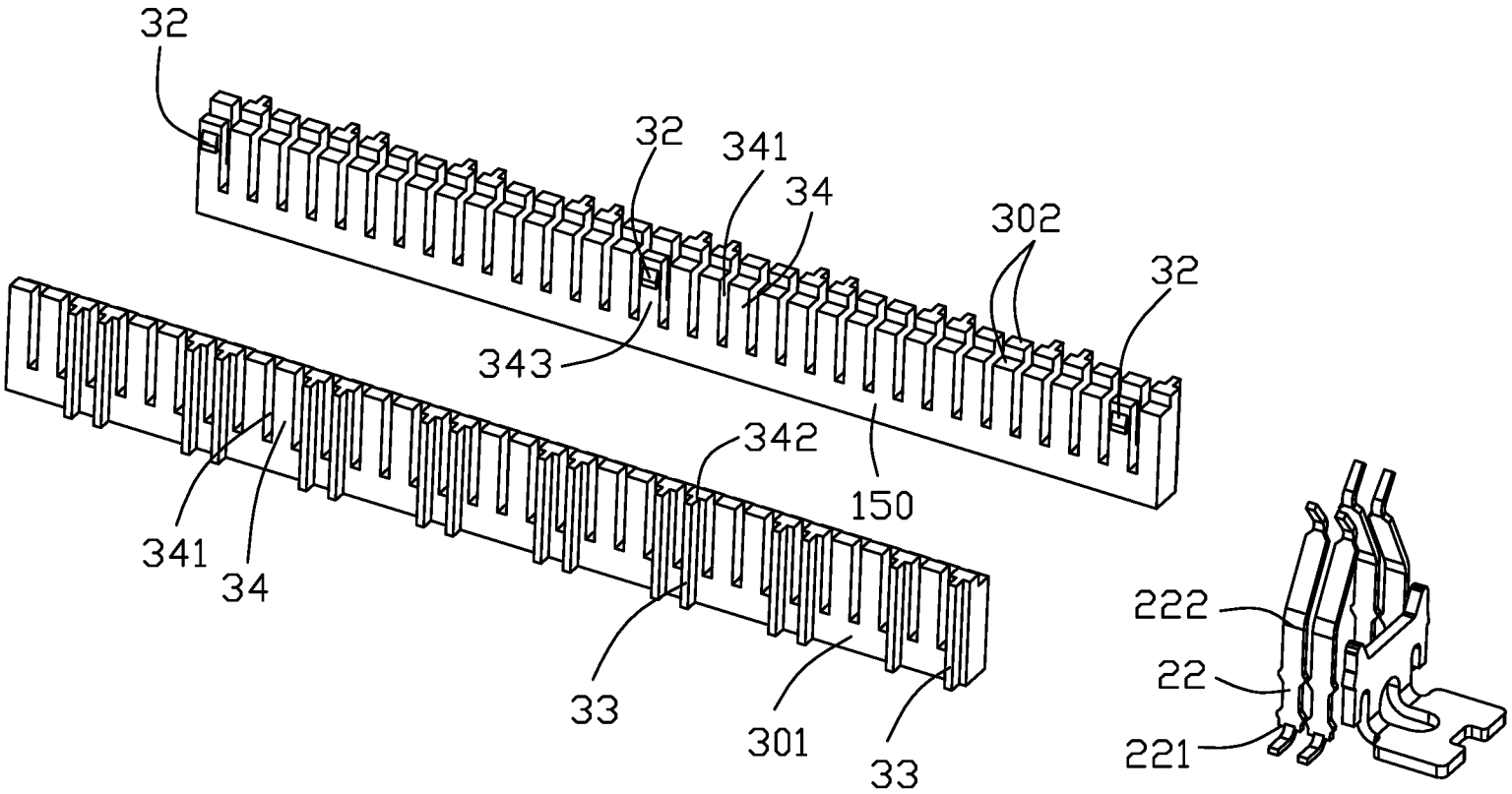
FIG. 6 is another exploded perspective view of the electrical connector of FIG. 3 without showing the housing.
Figure 7:
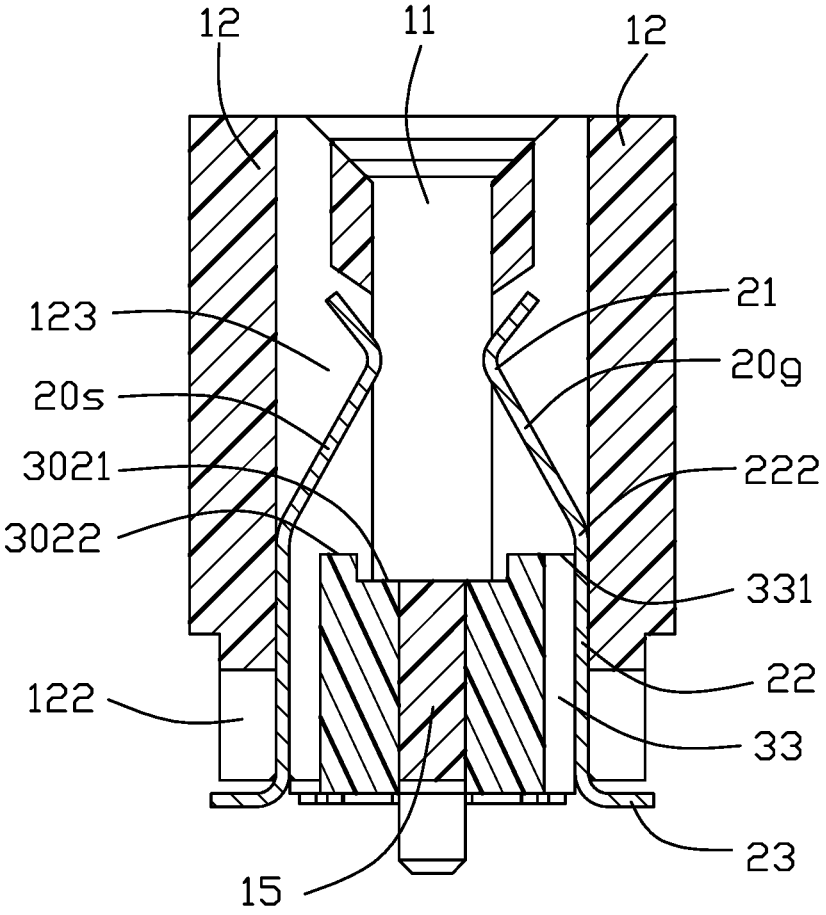
FIG. 7 is a cross-sectional view of the electrical connector of FIG. 1 along line 7-7.
Figure 8:
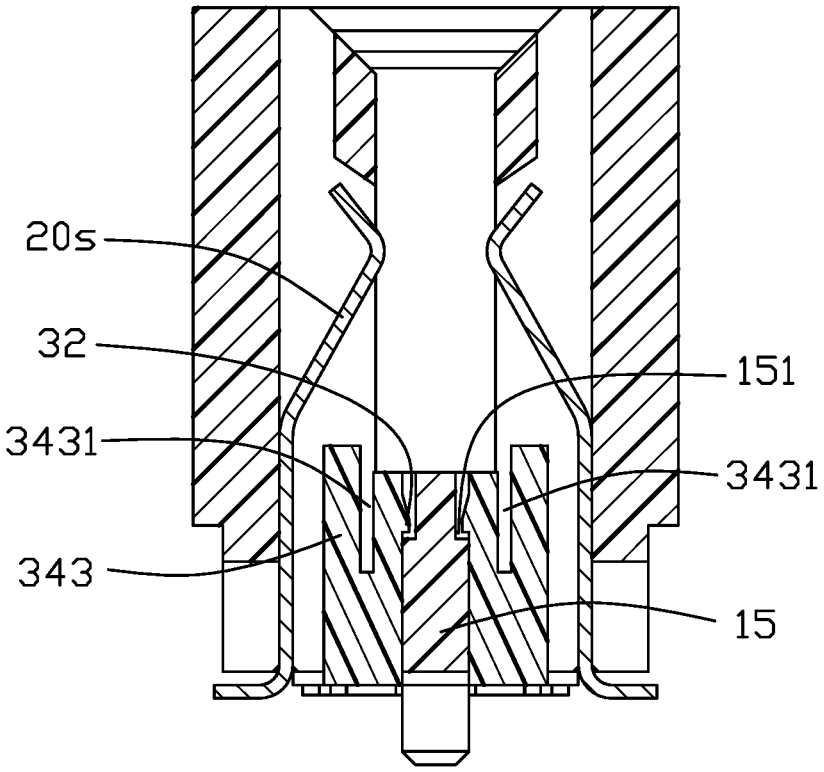
FIG. 8 is a cross-sectional view of the electrical connector of FIG. 1 along line 8-8.

Referring to FIGS. 1-8, an electrical connector 100 for use with a card like memory module, includes an elongated insulative housing 10 with two opposite side walls 12 each extending along a longitudinal direction, and two rows of passageways 123 respectively formed in two opposite side walls 12 with a central slot 11 therebetween in a transverse direction perpendicular to the longitudinal direction. Two rows of contacts 20 are disposed in the corresponding passageways, respectively, and include grounding contacts 20*g* and signal contacts 20*s*. A bottom wall 13 is located on a bottom portion of the housing 10. A pair of elongated channels 14 are formed in the bottom wall 13 and extend along the longitudinal direction and through the corresponding passageways 123. The housing forms an elongated central wall 15 between the pair of channels 14 and under the central slot 11. A pair of covering blocks 30 are upwardly assembled into the corresponding channels 14, respectively, after the contacts 20 are upwardly assembled into the corresponding passageways 123, respectively. As shown in FIGS. 7 and 8, the covering block 30 occupies more than one half of the corresponding passageway 123 in the transverse direction. In this embodiment, the covering block 30 is made of conductive plastic and forms a plurality of abutment ribs 31 to respectively abut against the corresponding grounding contacts 20*g*, respectively.

The signal contacts 20*s* and the grounding contacts 20*g* are essentially same with each other. The contact 20 includes a retaining section 22 for retaining the contact 20 to the housing 10, a resilient contacting section 21 extending into the central slot 11 and the soldering section 23 exposed outside of the housing 10 around the bottom wall 13. The bottom end of the retaining section 22 is flush with the bottom face 130 of the bottom wall 13. Notably, the longer the retaining section 22, the better the electrical performance of the contact 20.

The central wall 15 forms a plurality of engagement recesses 151, and the covering block 30 forms a plurality of deflectable locking lugs 32 to be engaged within the corresponding engagement recesses 151, respectively. Optionally, the covering block 30 may be glued within channel 14. The covering block 30 further forms a plurality of abutment ribs 33 with the abutment sections thereon to respectively abut against the retaining sections 22 of the corresponding grounding contacts 20*g*, respectively. The covering block 30 forms a plurality of slits 341 so as to form a plurality of fins 34 respectively inserted into the corresponding passageway 123 to confront the corresponding contacts 20. Actually, each slit 341 receives the corresponding partition wall 19 formed between the neighboring passageways 123 in the longitudinal direction. Notably, the abutment ribs 33 are formed integrally upon the corresponding fins 342, as one piece, which confront the grounding contacts 20*g*, and the locking lugs 32 are formed on the fins 342 which confront the signal contacts 20*s*. In this embodiment, only few fins 342 are equipped with the locking lugs 32. In this embodiment, to enhance outward resiliency of the locking lug 32 in the transverse direction, an additional slit 3431 is formed around the locking lug 32.

In this embodiment, the housing further forms an additional central slot 18 isolated from the central slot 11 with a key therebetween in the longitudinal direction. A plurality of openings 122 are formed in the bottom wall 13 in communicative alignment with the corresponding passageways 123 and extend laterally through the side wall 12 and downwardly through the bottom face 130 of the bottom wall 13 so as to expose the corresponding contact 20 to an exterior.

In this embodiment, the abutment rib 33 is located adjacent to the boundary 222 between the retaining section 22 and the contacting section 21. The covering block 30 has a lower top face 3021 flush with the top face of the central wall 15, and a higher top face 3022 flush with the top face 331 of the abutment rib 33. Therefore, the covering block 30 upwardly communicates with the central slot 11. The bottom face of the covering block 30 is flush with the bottom face of the abutment rib 33.

In this embodiment, on one hand the covering block 30 abuts laterally against the central wall 15 in the transverse direction with the corresponding deflectable locking lugs 32 engaged within the engagement recesses 151 of the housing 10. On the other hand, the covering block 30 is spaced from the corresponding signal contacts 20*s* while abutting against the corresponding grounding contacts 20*g*. Understandably, the covering block 30 may not require to abut against the grounding contacts 20*g* if shielding/covering effect is concerned about rather than grounding. In this embodiment, the covering block 30 is made of the conductive plastic. Alternately, an insulative covering block coated with the conductive layer on the surface for contacting the corresponding grounding contacts may be another economic approach.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including opposite side walls with a central slot therebetween in a transverse direction, each side wall extending in a longitudinal direction perpendicular to the transverse direction;

a bottom wall linked between the pair of side walls in the transverse direction and forming a central wall under the central slot in a vertical direction perpendicular to both the longitudinal direction and the transverse direction;

two rows of passageways formed in the corresponding side walls, respectively;

two rows of contacts disposed in the corresponding passageways, respectively, said contacts including signal contacts and grounding contacts;

each side wall further forming an elongated channel in the bottom wall to extend through the corresponding passageways in the longitudinal direction; and two covering blocks received within the corresponding channels, respectively, each covering block including a plurality of fins upwardly extending into the corresponding passageways, respectively; wherein an inner side of each corresponding fin abuts laterally and inwardly against the central wall intimately.

2. The electrical connector as claimed in claim 1, wherein the covering block forms a plurality of deflectable locking lugs to engage the central wall.

3. The electrical connector as claimed in claim 2, wherein the central wall forms a plurality of engagement recesses in which the corresponding locking lugs are received.

4. The electrical connector as claimed in claim 2, wherein the covering block forms a slot beside each corresponding locking lug so as to enhance resiliency of the locking lug in the transverse direction.

5. The electrical connector as claimed in claim 1, wherein each contact includes a vertical retaining section, and an outer side of the fin is spaced from the retaining section of the signal contact in the transverse direction.

6. The electrical connector as claimed in claim 1, wherein each contact includes a vertical retaining section, and an outer side of the fin forms an abutment rib to abut laterally against the retaining section of the grounding contact in the transverse direction.

7. The electrical connector as claimed in claim 6, wherein said covering block is electrically conductive.

8. The electrical connector as claimed in claim 7, wherein said covering block includes an insulative body coated with a conductive layer on exterior surfaces.

9. The electrical connector as claimed in claim 7, wherein said covering block is made of conductive plastic.

10. The electrical connector as claimed in claim 1, wherein a partition is formed every adjacent two passageways in the longitudinal direction, the covering block forms a plurality of slits alternately arranged with the fins along the longitudinal direction, and the partitions are received within the corresponding slits, respectively.

11. The electrical connector as claimed in claim 1, wherein each fin occupies at least one half of the corresponding passageway in the transverse direction.

12. The electrical connector as claimed in claim 1, wherein all the fins of the corresponding covering block laterally abut inwardly against the central wall in the transverse direction intimately.

13. An electrical connector comprising: an insulative housing including opposite side walls with a central slot therebetween in a transverse direction, each side wall extending in a longitudinal direction perpendicular to the transverse direction; a bottom wall linked between the pair of side walls in the transverse direction and forming a central wall under the central slot in a vertical direction perpendicular to both the longitudinal direction and the transverse direction; two rows of passageways formed in the corresponding side walls, respectively; two rows of contacts disposed in the corresponding passageways, respectively, said contacts including signal contacts and grounding contacts; each side wall further forming an elongated channel in the bottom wall to extend through the corresponding passageways in the longitudinal direction; and two covering blocks received within the corresponding channels, respectively, each covering block including a plurality of fins upwardly extending into the corresponding passageways, respectively, and each fin abuts inwardly against the central wall in the transverse direction; wherein each covering block is electrically conductive and mechanically and electrically connected to the corresponding grounding contacts while being spaced from the signal contacts.

14. The electrical connector as claimed in claim 13, wherein each covering block includes a plurality of deflectable locking lugs engaged with the central wall.

15. The electrical connector as claimed in claim 13, wherein some fins are equipped with corresponding abutment ribs to abut against vertical retaining sections of the corresponding grounding contacts, respectively.

16. A method of assembling an electrical connector comprising steps of:

providing an insulative housing with two opposite side walls each extending in a longitudinal direction, a central slot located between the two side walls in a transverse direction perpendicular to the longitudinal direction, two rows of passageways formed in the corresponding side walls, respectively, and two channels formed in the corresponding side walls with a central wall between the pair of channels in the transverse direction and under the central slot in a vertical direction perpendicular to both the longitudinal direction and the transverse direction;

upwardly assembling two rows of contacts into the corresponding passageways from a bottom face of the housing, respectively, said contacts including signal contacts and grounding contacts; and upwardly assembling two covering blocks into the corresponding channels from the bottom face only after the contacts have been assembled into the corresponding passageways, wherein each covering block forms a plurality of fins respectively received within the corresponding passageways, respectively, and at least some fins abut inwardly against the central wall in the transverse direction, and at least some fins abut outwardly against the corresponding contacts in the transverse direction so as to have the covering block stably retained in the corresponding channel without movement in the transverse direction.

17. The method as claimed n claim 16, wherein some of the at least some fins which are inwardly abut against the central wall, are equipped with deflectable locking lugs to be engagement within corresponding engagement recesses in the central wall.

18. The method as claimed in claim 17, wherein the covering block forms a slit behind each corresponding deflectable locking lug to enhance resiliency of the locking lug.

19. The method as claimed in claim 16, wherein said covering block is electrically conductive, and the at least some fins which outwardly abut against the corresponding contacts are equipped with corresponding abutment ribs to abut against the grounding contacts.

* * * * *